US012617503B1

(12) United States Patent
Kalnins

(10) Patent No.: US 12,617,503 B1
(45) Date of Patent: May 5, 2026

(54) METHOD AND SYSTEM FOR MONITORING WIND AND CURRENT AROUND A MARINE VESSEL

(71) Applicant: Brunswick Corporation, Mettawa, IL (US)

(72) Inventor: Jared D. Kalnins, Neenah, WI (US)

(73) Assignee: Brunswick Corporation, Mettawa, IL (US)

( * ) Notice: Subject to any disclaimer, the term of this patent is extended or adjusted under 35 U.S.C. 154(b) by 183 days.

(21) Appl. No.: 18/489,271

(22) Filed: Oct. 18, 2023

Related U.S. Application Data

(60) Provisional application No. 63/421,726, filed on Nov. 2, 2022, provisional application No. 63/421,730, filed on Nov. 2, 2022.

(51) Int. Cl.
*B63B 79/15* (2020.01)
*B63B 79/40* (2020.01)

(52) U.S. Cl.
CPC ..... *B63B 79/15* (2020.01); *B63B 79/40* (2020.01)

(58) Field of Classification Search
CPC ..... B63B 79/15; B63B 79/40; B63H 21/21; B63H 25/04; B63H 2021/216; G05D 1/0206; G05D 1/0875
See application file for complete search history.

(56) References Cited

U.S. PATENT DOCUMENTS 6,885,919 B1 4/2005 Wyant et al.
10,198,005 B2 2/2019 Arbuckle et al.
10,845,812 B2 11/2020 Ward et al.
2023/0219675 A1 7/2023 Janeczko et al.
2023/0219676 A1 7/2023 Kalnins et al.

OTHER PUBLICATIONS

Dhariwal et al., Experiments in robotic boat localization, 2007, IEEE, p. 1702-171708 (Year: 2007).*
Skulstad et al., Dead Reckoning of Dynamically Positioned Ships: Using an Efficient Recurrent Neural Network, 2019, IEEE, p. 39 -51 (Year: 2019).*
Gangesk, Verifying High-Accuracy Ocean Surface Current Measurements by X-Band Radar for Fixed and Moving Installations, 2018, IEEE, p. 4845-4855 (Year: 2018).*
Fossen et al., Kalman filtering for positioning and heading control of ships and offshore rigs, 2009, IEEE, p. 33-46 (Year: 2009).*

* cited by examiner

*Primary Examiner* — Mcdieunel Marc
(74) *Attorney, Agent, or Firm* — Andrus Intellectual Property Law, LLP

(57) ABSTRACT

A method of monitoring an environment around a marine vessel includes receiving a plurality of air speed measurements and/or a plurality of water speed measurements measured by at least one environmental speed sensor on the marine vessel when the marine vessel is heading in a plurality of different heading directions. A plurality of wind velocities and/or a plurality of current velocities are determined based on the plurality of air speed measurements and/or the plurality of water speed measurements and the vessel speed over ground and the vessel heading direction at the time of obtaining each respective air speed measurement and/or water speed measurement. A wind vector and/or a current vector are then calculated for an area traveled by the vessel based on the plurality of wind velocities and/or the plurality of current velocities.

21 Claims, 6 Drawing Sheets

METHOD AND SYSTEM FOR MONITORING WIND AND CURRENT AROUND A MARINE VESSEL

CROSS-REFERENCE TO RELATED APPLICATION

This application claims benefit of priority to U.S. Provisional Application No. 63/421,730, filed Nov. 2, 2022 and U.S. Provisional Application No. 63/421,726, filed on Nov. 2, 2022, the contents of which are each hereby incorporated by reference in their entirety.

FIELD

The present disclosure generally relates to systems and methods for monitoring an environment around the vessel, and more particularly to monitoring wind and current vectors around the marine vessel.

BACKGROUND

The following U.S. patents and applications provide background information and are incorporated herein by reference, in entirety.

U.S. Pat. No. 6,885,919 discloses a process is provided by which the operator of a marine vessel can invoke the operation of a computer program that investigates various alternatives that can improve the range of the marine vessel. The distance between the current location of the marine vessel and a desired waypoint is determined and compared to a range of the marine vessel which is determined as a function of available fuel, vessel speed, fuel usage rate, and engine speed. The computer program investigates the results that would be achieved, theoretically, from a change in engine speed. Both increases and decreases in engine speed are reviewed and additional theoretical ranges are calculated as a function of those new engine speeds. The operator of the marine vessel is informed when an advantageous change in engine speed is determined.

U.S. Pat. No. 10,198,005 discloses a method for controlling movement of a marine vessel that includes controlling a propulsion device to automatically maneuver the vessel along a track including a series of waypoints, and determining whether the next waypoint is a stopover waypoint at or near which the vessel is to electronically anchor. If the next waypoint is the stopover waypoint, a control module calculates a distance between the vessel and the stopover waypoint. In response to the calculated distance being less than or equal to a threshold distance, the propulsion device's thrust is decreased. In response to sensing that the vessel thereafter slows to a first threshold speed, the vessel's speed is further reduced. In response to sensing that the vessel thereafter slows to a second, lower threshold speed or passes the stopover waypoint, the propulsion device is controlled to maintain the vessel at an anchor point that is at or near the stopover waypoint.

U.S. Pat. No. 10,845,812 discloses a system for controlling movement of a marine vessel near an object. The system includes a control module in signal communication with a marine propulsion system, a manually operable input device providing a signal representing a requested translation of the marine vessel, and a sensor providing a first distance between the vessel and a first point on the object and a second distance between the vessel and a second point on the object. The control module determines an actual angle between the vessel and the object based on the first distance and the second distance. In response to the signal representing the requested translation, the control module stores the actual angle between the vessel and the object as an initial angle and controls the marine propulsion system to produce thrust that will carry out the requested translation and that will maintain the initial angle.

U.S. Publication No. 2023/0219675 discloses a method of controlling an electric marine propulsion system to propel a marine vessel that includes receiving a user-set time, determining a time remaining based on the user-set time, and identifying a battery charge level of a power storage system on the marine vessel. A required battery power is then determined based on the time remaining and the battery charge level, and then an output limit is determined based on the required battery power to enable propelling the marine vessel for the user-set time without recharging the power storage system. The propulsion system is automatically controlled so as not to exceed the output limit.

U.S. Publication No. 2023/0219676 discloses a method of controlling an electric marine propulsion system configured to propel a marine vessel that includes receiving a user-set distance, identifying a battery charge level of a power storage system on a marine vessel and identifying an energy utilization value. An output limit is then determined based on a remaining distance, the battery charge level, and the energy utilization value. The propulsion system is then automatically controlled so as to not exceed the output limit, enabling the marine vessel to travel the user-set distance without recharging the power storage system.

U.S. application Ser. No. 18/314,048 discloses a propulsion system for a marine vessel that includes a plurality of marine drives configured to effectuate propulsion on the marine vessel and a control system. The control system is configured to determine a disturbance vector representing an environmental disturbance on the marine vessel and identify a propulsion response capability of the plurality of marine drives to oppose the disturbance vector. When a request is received to perform an autonomous action, the control system determines whether insufficient propulsion authority is available to perform the requested autonomous action based on the disturbance vector and the propulsion response capability and, if so, generates an insufficiency alert on a user interface to advise a user of the insufficient propulsion authority.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a system for monitoring an environment around a marine vessel includes at least one environmental speed sensor configured to measure at least one of an air speed or a water speed around the marine vessel, a vessel sensing system configured to measure a speed over ground of the marine vessel and a heading direction of the marine vessel and a control system. The control system is configured to receive a plurality of air speed measurements and/or a plurality of water speed measurements measured by the at least one environmental speed sensor when the marine vessel is heading in a plurality of different heading directions, determine a plurality of wind velocities and/or a plurality of current velocities based on the plurality of air speed measurements and/or the plurality of water speed measurements and the vessel speed over ground and the vessel heading direction at the time of obtaining each respective air speed measurement and/or water speed measurement, and calculate a wind vector and/or a current vector for an area traveled by the vessel based on the plurality of wind velocities and/or the plurality of current velocities.

In one embodiment, a method of monitoring an environment around a marine vessel includes receiving a plurality of air speed measurements and/or a plurality of water speed measurements measured by at least one environmental speed sensor on the marine vessel when the marine vessel is heading in a plurality of different heading directions. A plurality of wind velocities and/or a plurality of current velocities are determined based on the plurality of air speed measurements and/or the plurality of water speed measurements and the vessel speed over ground and the vessel heading direction at the time of obtaining each respective air speed measurement and/or water speed measurement. A wind vector and/or a current vector are then calculated for an area traveled by the vessel based on the plurality of wind velocities and/or the plurality of current velocities.

In another embodiment, a method of monitoring an environment around a marine vessel includes measuring a first air speed and/or a first water speed with at least one environmental speed sensor on the marine vessel and measuring a first speed over ground of the marine vessel when the marine vessel is at a first location traveling in a first heading direction. A first wind velocity relative to the first heading direction is determined based on the first air speed and the first speed over ground and/or a first current velocity relative to the first heading direction is determined based on the first water speed and the first speed over ground. After threshold change in heading direction of the marine vessel to a second heading direction is detected, a second air speed and/or a second water speed are measured with the speed sensor on the marine vessel and a second speed over ground of the marine vessel is measured when the marine vessel is at a second location traveling in the second heading direction. The method includes determining a second wind velocity based on the second air speed and the second speed over ground and/or determining a second current velocity based on the second water speed and the second speed over ground, and calculating a wind vector for a first area based on the first wind velocity and the second wind velocity and/or calculating a current vector for the first area based on the first current velocity and the second current velocity, wherein the first area includes at least the first location and the second location.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
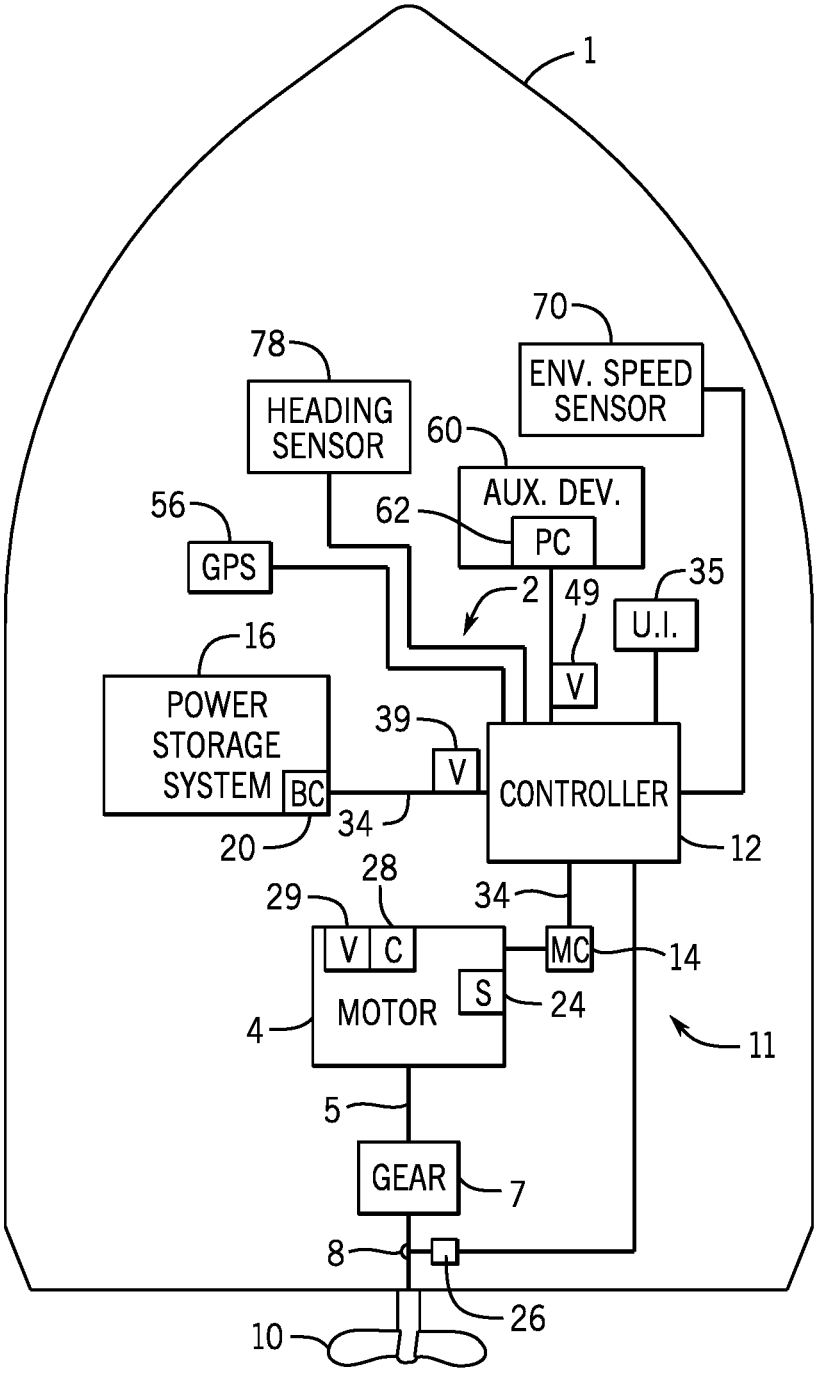
FIG. 1 is a schematic depiction of a marine vessel having an exemplary electric marine propulsion system in accordance with the present disclosure.

The inventor has recognized a need for systems and methods that calculate and track environmental conditions around a marine vessel, including wind vectors and water current vectors, using simple speed sensors on the marine vessel, such as a unidirectional wind speed sensor and/or a unidirectional water speed sensor. To provide just a few examples, tracking wind and current directions can be useful for determining and planning optimized routes, calculating optimal propulsion speeds (such as for autonomous control), and predicting energy utilization for traveling certain distances/directions and/or achieving certain speeds.

The inventor has recognized that environmental condition calculation and tracking is particularly needed for electric propulsion, where battery range estimation needs to be improved to account for drag caused by wind and current. Additionally, the inventor recognized that route planning and other trip management functions can be greatly improved by accounting for wind, current, and wave direction, as well as the impact of each those environmental factors on the vessel. The net impact can be determined thereafter. For example, water current is often in a different direction than air current, or wind, and each of wind and current impact the vessel differently. Water current may be a consistent and unidirectional movement of water (such as in the case of a river), or may be due to tides or other periodically changing phenomena, or may be due to or include weather-induced movements such as waves. Thus, the inventor has recognized that, in some embodiments, it is preferable to measure each of wind and water current so that the impact of each can be separately accounted for.

In view of the foregoing challenges and problems in the relevant art, the inventor developed the disclosed method and system that determines a velocity in the environment around a marine vessel by measuring air speed and water speed from the marine vessel in at least two different locations when the vessel is heading in different directions. From that information, as well as based on the vessel's measured speed over ground and heading in each of the at least two different directions, a wind vector can be determined describing the direction and speed of the wind and/or a current vector can be determined describing a direction and vector of the current. The wind vector and/or current vector are calculated by normalizing the two velocity vectors into a North/South, East/West coordinate system. For example, the wind vector may be presented as an East Wind value (which may be positive or negative to indicate the wind velocity in the East/West direction) and a North Wind value (which may be positive or negative to indicate the wind velocity in the North/South direction). In various embodiments, just wind speed may be measured and just a wind vector may be calculated, or just water speed may be measured and just a current vector may be calculated, or both wind and water speeds may be measured and both a wind vector and a current vector may be determined.

In one embodiment, air speed and/or a water speed are measured when the marine vessel is at a first location traveling in a first heading direction. The air speed and water speed are each measured with an environmental speed sensor on the marine vessel, where the air speed is measured with an air speed sensor mounted on the marine vessel above the water surface and the water speed is measured with a water speed sensor mounted on the marine vessel below the water surface. A speed over ground of the marine vessel is also measured when the marine vessel is at the first location. The output of the environmental speed sensor(s) and the measured speed over ground are provided to the control system, which is configured to calculate one or more environmental vectors based thereon. A wind velocity relative to the first heading direction can then be determined by subtracting the speed over ground from the measured air speed. Likewise, a current velocity of the water relative to the first heading direction can also be determined by subtracting the speed over ground from the measured water speed.

Once a threshold change in heading direction is made and the marine vessel is heading in a second heading direction, the air speed and/or water speed measurements are reperformed and a second wind velocity and/or second current velocity are determined relative to the second heading direction. Since the first heading direction and the second heading direction are known, a wind vector and/or a current vector can be determined for the area encompassing the first and second locations. The wind vector is calculated based on the first wind velocity and the second wind velocity. Similarly, the current vector is calculated based on the first current velocity and the second current velocity. The wind vector and/or the current vector can then be stored and used to plan or predict a thrust output requirement or an energy output requirement by a marine drive on the marine vessel to propel the marine vessel in a given direction for a given distance. Alternatively or additionally, the wind vector and/or the current vector may be represented on a display, such as at the helm area of the marine vessel and/or on the user's mobile device.

Alternatively or additionally, the wind vector and/or the current vector may be utilized to generate a map of environmental vectors for one or more areas where the vessel has traveled. The disclosed method and system for wind vector and/or current vector calculations may be repeated in a plurality of measurement areas as the vessel moves and changes direction to generate a plurality of corresponding wind vectors and/or current vectors. A map of wind and/or current vectors may then be generated containing the plurality of vectors for the corresponding plurality of areas, thus mapping the wind vectors and/or current vectors for a larger area where the vessel has traveled. This map may then be stored and/or displayed, such as at the helm area of the marine vessel and/or on the user's mobile device, communicated to a computing system remote from the vessel (such as in crowd-sourcing applications), and/or utilized for assessing propulsion system parameter(s) and/or propulsion output requirement(s), such as for assessing on-board energy stores in route planning.

Figure 2:
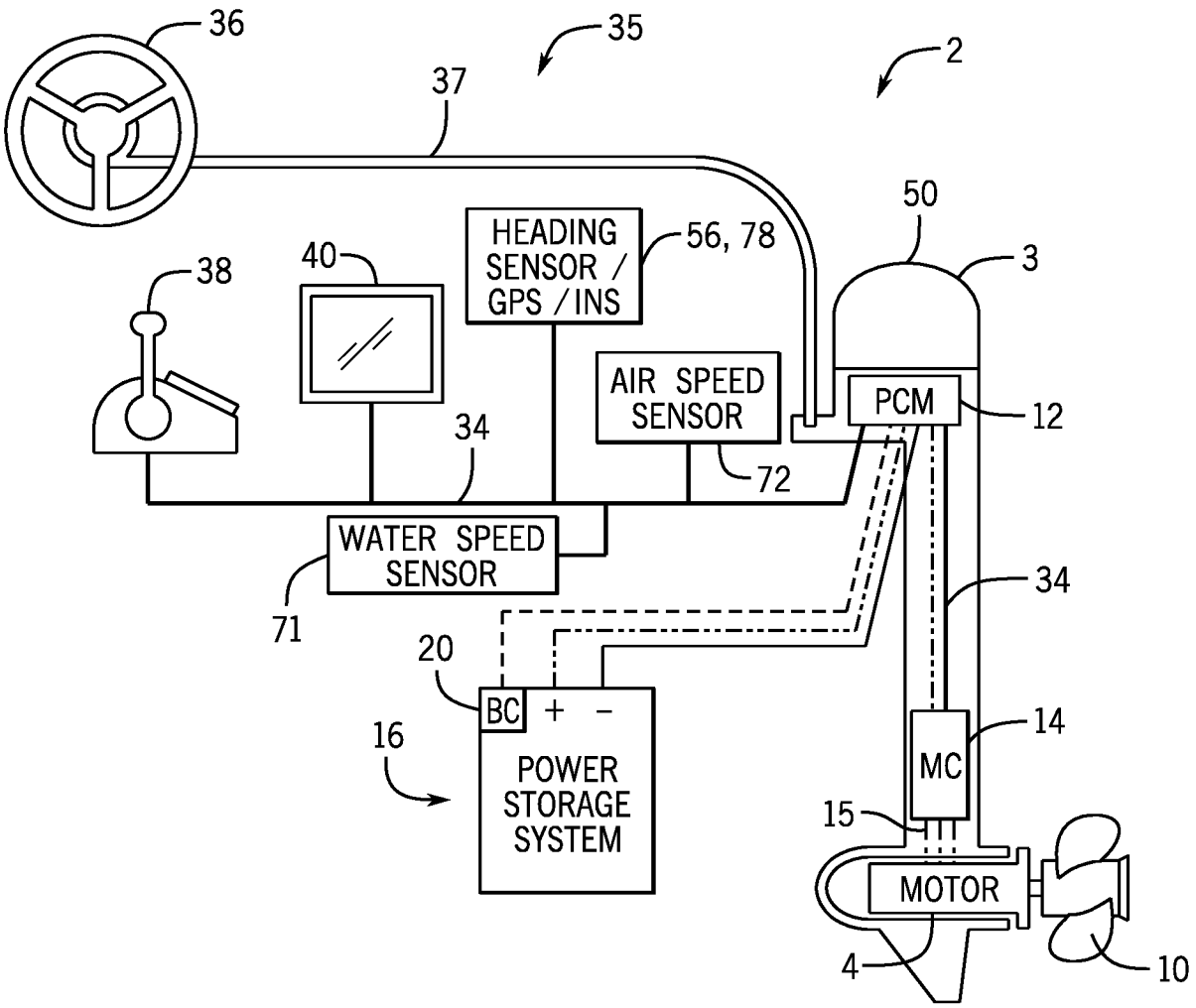
FIG. 2 is a schematic of another exemplary electric marine propulsion system in accordance with the present disclosure.

FIG. 1 depicts an exemplary embodiment of a marine vessel 1 having a marine propulsion system 2 configured to propel the marine vessel. In the depicted embodiments, the marine propulsion system is an electric marine propulsion system comprising at least one marine drive 3 having an electric power head; however, a person of ordinary skill in the art will recognize that the disclosed method and system may also be utilized in conjunction with other types of marine propulsion systems and drives, such as those having internal combustion engine powerheads. Referring also to FIG. 2, the electric propulsion system 2 includes at least one electric marine drive 3 having an electric motor 4 configured to propel the marine vessel 1 by rotating a propeller 10, as well as a power storage system 16, and a user interface system 35. In the depicted embodiment of FIG. 2, the electric marine propulsion system 2 includes an outboard marine drive 3 having an electric motor 4 housed therein, such as housed within the cowl 50 of the outboard marine drive. A person of ordinary skill in the art will understand in view of the present disclosure that the marine propulsion system 2 may include other marine drive 3 configurations, such as inboard drives (as represented in FIG. 1) or stern drives. The electric marine drive 3 is powered by the scalable storage device 16, such as a marine battery or bank of batteries.

The electric marine propulsion system 2 may include one or a plurality of electric marine drives 3, each comprising at least one electric motor 4 configured to rotate a propulsor, or propeller 10. The motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. In certain embodiments, the electric motor 4 includes a rotor and a stator in a known configuration.

The electric motor 4 is electrically connected to and powered by a power storage system 16. The power storage system 16 stores energy for powering the electric motor 4. Various power storage devices and systems are known in the relevant art. The power storage system 16 may be a battery system configured to receive one or more batteries or banks of batteries of different varieties including OEM batteries, third party batteries, or both. For example, the power storage system 16 may include one or more lithium-ion (LI) battery systems, each LI battery comprised of multiple battery cells. In other embodiments, the power storage system 16 may include one or more lead-acid batteries, fuel cells, flow batteries, ultracapacitors, and/or other devices capable of storing and outputting electric energy.

The electric motor 4 is operably connected to the propeller 10 and configured to rotate the propeller 10. As will be known to the ordinary skilled person in the relevant art, the propeller 10 may include one or more propellers, impellers, or other propulsor devices and the term "propeller" may be used to refer to all such devices. In certain embodiments, such as that represented in FIG. 1, the electric motor 4 may be connected and configured to rotate the propeller 10 through a gear system 7 or a transmission. In such an embodiment, the gear system 7 translates rotation of the motor output shaft 5 to the propeller shaft 8 to adjust conversion of the rotation and/or to disconnect the propeller shaft 8 from the drive shaft 5, as is sometimes referred to in the art as a "neutral" position where rotation of the drive shaft 5 is not translated to the propeller shaft 8. Various gear systems 7, or transmissions, are well known in the relevant art. In other embodiments, the electric motor 4 may directly connect to the propeller shaft 8 such that rotation of the drive shaft 5 is directly transmitted to the propeller shaft 8 at a constant and fixed ratio.

A control system 11 controls the electric marine propulsion system 2, wherein the control system 11 may include a plurality of control devices, or controllers, configured to cooperate to provide the method of controlling the electric marine propulsion system described herein. For example, the control system 11 may include a central controller 12, and one or more motor controllers, trim controllers, steering controllers, battery controllers, power controllers, navigation controllers, etc. communicatively connected, such as by a communication bus or other communication link. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Each controller may comprise a processor and a storage device, or memory, configured to store software and/or data utilized for controlling and/or tracking operation of the electric propulsion system 2. The memory may include volatile and/or non-volatile systems and may include removable and/or non-removable media implemented in any method or technology for storing information. The storage media may include non-transitory and/or transitory storage media, including random access memory, read only memory, or any other medium which can be used to store information and be accessed by an instruction execution system, for example. Such information may include a command table containing a set of adjustment commands based on measured or calculated values. An input/output (I/O) system facilitates communication between the control system 11 and connected devices, including facilitating communication of the environmental speed measurements by the environmental speed sensor(s) 70, 71.

Each electric motor 4 may be associated with a motor controller 14 configured to control power to the electric motor, such as to the stator winding thereof. The motor controller 14 is configured to control the function and output of the electric motor 4, such as controlling the torque outputted by the motor 4, the rotational speed of the motor 4, as well as the input current, voltage, and power supplied to and utilized by the motor 4. In one arrangement, the motor controller 14 controls the current delivered to the stator windings via the leads 15, which input electrical energy to the electric motor to induce and control rotation of the rotor.

In certain embodiments, various sensing devices 24, 26, 28, 29, 39, 49 may be configured to communicate with a local controller, such as the motor controller 14 or power controller 62 and/or other controllers in the control system 11. In other embodiments, the sensors 24, 26, 28, 29, 39, 49 may communicate with the central controller 12 and the motor controller 14 may be eliminated. The system includes a vessel sensing system comprising one or more sensors or measurement systems configured to measure a speed over ground of the marine vessel and a heading direction of the vessel and provide such information to the control system 11. A GPS system 56 may also be configured to determine a current global position of the vessel, track vessel position over time, determine vessel speed over ground, and/or determine the vessels' direction of travel, or heading direction, and to provide such information to the controller 12 and/or other controllers in the control system 11. Alternatively, instead of a GPS system 56, the vessel may include a global navigation satellite system (GNSS), or a GNSS/INS (inertial navigation system) configured to measure vessel speed over ground and/or heading direction of the vessel. Alternatively or additionally, the vessel 1 may be equipped with a heading sensor 78 configured to measure the vessels' heading. The vessel heading sensor 78 may include a compass, a gyroscope, an accelerometer, and/or other elements configured to measure vessel position and/or movement. For example, the heading sensor may be part of an inertial measurement unit (IMU) or similar, such as IMU having a solid state, rate gyro electronic compass that detects the direction of the earth's magnetic field using solid-state magnetometers and indicates the vessel heading relative to magnetic north.

Additionally, one or more environmental sensors 70 are configured to measure air and/or water speed around the marine vessel and such information may be provided to the controller 12. Referring also to FIG. 2, the environmental sensors include a water speed sensor 71 and an air speed sensor 72. The water speed sensor 71 may be a unidirectional sensor, such as a pitot tube or a paddle wheel, mounted to the hull under the waterline and configured to measure water speed in the direction of travel of the vessel and with respect to the vessel's hull, and thus to measure the vessel's speed-over-water. Similarly, the air speed sensor 72 may be a unidirectional sensor, such as a pitot tube or a paddle wheel, mounted to the vessel above the waterline, such as at a location at or near the highest point on the vessel that will not be protected or obstructed from measuring the air flow over the vessel. The air speed sensor 72 may be configured to measure air speed in the direction of travel of the vessel and with respect to the vessel, and thus to measure the vessel's speed-through-air.

In some embodiments, a plurality of air speed sensors 72 may be located at different locations on the marine vessel 1, wherein each is configured to measure air speed at its respective location. For example, one air speed sensor may be located at or near the front of the bow and a second air speed sensor may be located at or near the highest point on the marine vessel, such as atop the Bimini top or on the antennae tower. An aggregate airspeed value can then be determined based on the plurality of local measurements on the vessel, such as by averaging the plurality of local measurements or using other calculation techniques to determine a filtered airspeed value that is less influenced by local air disturbances, measurement error, etc. Similarly, an aggregate water speed value may be determined based on measurements from a plurality of water speed sensors 71 mounted at different locations on the vessel hull below the waterline.

Controllers 12 and 14 (and or the various sensors and systems) may be configured to communicate via a common communication link 34. The one or more communication links may be a wired link, such as a bus, or may be a wireless communication link, such as via any wireless protocol. In one embodiment, the communication link 34 is a CAN bus (e.g., configured as a CAN Kingdom Network), or alternatively may be a LIN bus. In some embodiments, one or more devices may be connected by dedicated communication link, such as a dedicated communication bus or link between controllers 12 and 14.

Sensors may be configured to sense the power, including the current and voltage, delivered to the motor 4 and/or voltage sensed at other locations within the system. For example, a plurality of voltage sensors 29, 39, 49 may be configured to sense voltage at various locations within the system. Voltage sensor 29 may be configured to sense the input voltage to the motor 4 and a current sensor 28 may be configured to measure input current to the motor 4. Accordingly, power delivered to the motor 4 can be calculated and such value can be used for monitoring and controlling the electric propulsion system 2, including for monitoring and controlling the motor 4 and ensuring the system 2 is operating within the capabilities of the electric motor 4. Alternatively or additionally, the system 2 may include a voltage sensor 39 at or near the connection point of the vessel system(s) to the power storage system 16 to sense the voltage at the location(s) of power input. Alternatively or additionally, a voltage sensor 49, or multiple voltage sensors, may be located to measure voltage powering one or more auxiliary devices 60. In certain embodiments, the voltage sensor 49 may comprise part of the power controller 62 for the auxiliary power system and/or may be configured to measure voltage at one or more converters, such as a DC-DC converter powering auxiliary electronics or other auxiliary devices.

In the depicted example, the current sensor 28 and voltage sensor 29 may be communicatively connected to the motor controller 14 to provide measurement of the voltage supplied to the motor and current supplied to the motor. Other voltage sensor(s) 39, 49 may be configured to provide voltage measurement outputs to the controller 12 and/or the motor controller 14. The motor controller 14 is configured to provide appropriate current and or voltage to meet the demand for controlling the motor 4. For example, a demand input may be received at the motor controller 14 from the central controller 12, such as based on an operator demand at a helm input device, such as the throttle lever 38. In certain embodiments, the motor controller 14, voltage sensor 28, and current sensor 29 may be integrated into a housing of the electric motor 4, and in other embodiments the motor controller 14 may be separately housed.

Various other sensors may be configured to measure and report parameters of the electric motor 4. For example, the electric motor 4 may include means for measuring and or determining the torque, rotation speed (motor speed), current, voltage, temperature, vibration, or any other parameter. In the depicted example, the electric motor 4 includes a speed sensor 24 configured to measure the rotational speed of the motor 4 (motor RPM). Alternatively or additionally, propeller speed sensor 26 may be configured to measure the rotational speed of the propeller 10. For example, the propeller speed sensor 26 and/or the motor speed sensor 24 may be a Hall Effect sensor or other rotation sensor, such as using capacitive or inductive measuring techniques. In certain embodiments, one or more of the parameters, such as the speed, torque, or power to the electric motor 4, may be calculated based on other measured parameters or characteristics. For example, the torque may be calculated based on power characteristics in relation to the rotation speed of the electric motor, for example.

At least one battery controller 20 is configured to monitor the power storage system 16. For example, the battery or each of a plurality of batteries in the power storage system 16 may have an associated a battery controller 20 configured to monitor various battery parameters, such as current, voltage, temperature, etc. and communicate those parameters within the control system, such as to the central controller 12 and/or the motor controller 14. For instance, each battery controller may be configured to periodically determine and communicate via the communication link 34 each of a charge level (e.g., battery state of charge and/or battery voltage), battery temperature, and battery state of health for each of its associated batteries, battery connection and operation status, as well as other parameters and operation information for the battery.

The central controller 12, which in the embodiment shown in FIG. 2 is a propulsion control module (PCM), communicates with the motor controller 14 and the battery controller 20 via communication link 34, such as a CAN bus. The controller also receives input from and/or communicates with one or more user interface devices in the user interface system 35 via the communication link, which in some embodiments may be the same communication link as utilized for communication between the controllers 12 and 14 or may be a separate communication link. The user interface devices in the exemplary embodiment include a throttle lever 38 and a display 40. In various embodiments, the display 40 may be, for example, part of an onboard management system, such as the VesselView™ by Mercury Marine of Fond du Lac, Wisconsin. Alternatively or additionally, the user interface devices may include a user's mobile device, such as a cell phone or other portable computing device running an application, such as VesselView Mobile™, configured to communicate with one or more controllers in the control system 11. A steering wheel 36 is provided, which in some embodiments may communicate with the controller 12 or other control device in the control system 11 to effectuate steering control over the marine drive 3, which is well-known and typically referred to as a steer-by-wire arrangement. Alternatively, as in the depicted embodiment, the steering wheel 36 is a wired steering arrangement where the steering wheel 36 is connected to a steering actuator that steers the marine drive 3 by a steering cable 37. Other steering arrangements, such as various wired and steer-by-wire arrangements, are well-known in the art and could alternatively be implemented.

The various parameters of the electric propulsion system are utilized for providing user-controlled or automatically effectuated vessel power control functionality appropriate for optimizing power usage. The system may be configured to control power usage by the electric propulsion system 2, for example so that power available and utilized to effectuate propulsion remains within calculated limits to provide consistent propulsion and operate the motors within the rated operation parameters. The system may be configured to operate in a variety of user-selectable power modes, or in various power modes that may be automatically selected by the control system 11 based on sensed parameters and/or operating conditions of the propulsion system 2.

The power storage system 16 may further be configured to power auxiliary devices 60 on the marine vessel 1 that are not part of the propulsion system 2. For example, the auxiliary devices may include a bilge pump, cabin lights, a stereo system or other entertainment devices on the vessel, a water heater, a refrigerator, an air conditioner or other climate/comfort control devices on the vessel, communication systems, navigation systems, or the like. Some or all these accessory devices are sometimes referred to as a "house load" and may consume a substantial amount of battery power. Additionally, other non-motor loads may be powered by the power storage system 16, such as steering, motor trim, trim tabs, and other devices relating to steering and/or vessel orientation control.

The power consumption by some or all of the auxiliary devices and/or non-motor loads may be monitored and/or controllable, such as by a power controller 62 associated with each controlled auxiliary device or a group of auxiliary devices (FIG. 1). The power controller 62 is communicatively connected to the controller 12 or is otherwise communicating with one or more controllers in the control system 11, in order to monitor and/or control power consumption by such auxiliary devices. For example, the power controller 62 may be configured to communicate with one or more power monitoring or other control devices via CAN bus or LIN bus, and to then control operation of the auxiliary device and/or power delivery to the auxiliary device according to received instructions. For instance, the system may be configured to reduce power delivery or prevent change in power delivery to the device(s) 60 during certain measurement periods, or to selectively turn off the auxiliary device (s) 60 by turning on or off power delivery to the device(s) 60 associated with the power controller 62 during the measurement period. For example, the power controller 62 for one or a set of auxiliary devices may include a battery switch controlling power thereto. The control system 11 may thus include digital switching system configured to control power to the various auxiliary devices, such as a CZone Control and Monitoring system by Power Products, LLC of Menomonee Falls, WI. Other examples of power control arrangements are further exemplified and described in U.S. application Ser. Nos. 17/009,412 and 16/923,866, which are each incorporated herein by reference in their entirety.

Figure 3:
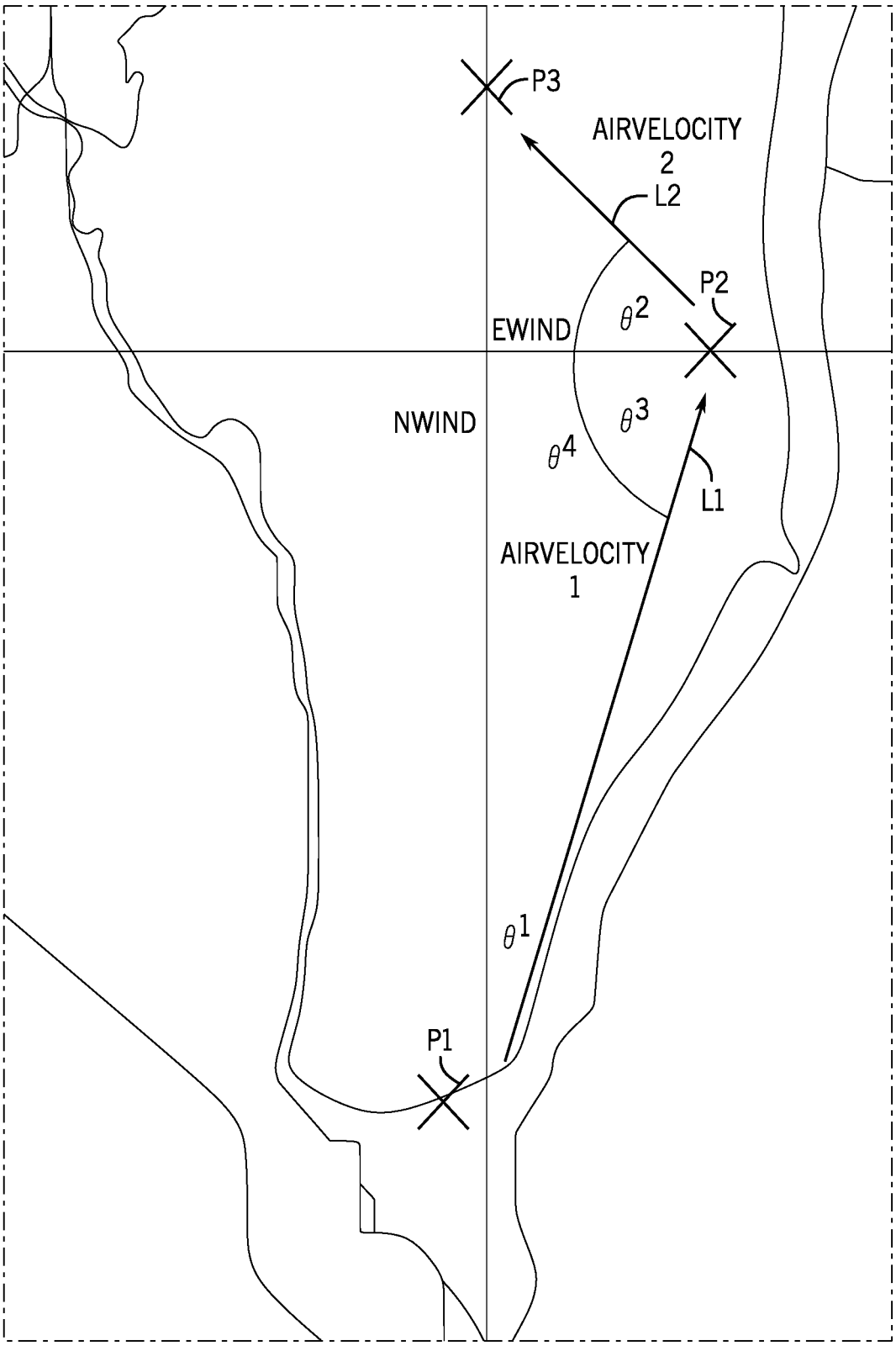
FIGS. 3 and 4 illustrate exemplary scenarios for calculating wind vectors and/or current vectors according to the present disclosure.

As described above, the disclosed method and system are configured to monitor the environment around the marine vessel and to determine wind and/or current vectors for one or more areas that the vessel occupies. FIG. 3 illustrates an exemplary scenario illustrating a vessel travel path between a start location and a present location of the vessel—e.g., between location P1 and location P3 when the vessel is at location P3—which is in a known heading direction (e.g., measured by heading sensor 78 and/or determined based on GPS information). Air speed and/or water speed are measured by environmental speed sensors 71 and 72 along a first leg L1 between the start location P1 and a second location P2. For each air and/or water speed measurement, a corresponding speed over ground is determined for the marine vessel by a vessel speed sensor, such as by the GPS system 56 and/or based on GPS information therefrom. The speed over ground is subtracted from each air speed and water speed measurement to isolate a wind velocity and/or a current velocity for each measurement. Each wind velocity and/or a current velocity are then stored in association with, or relative to, the current heading direction of the marine vessel when the measurement was made.

At point P2, the vessel turns, changing heading direction by at least a threshold amount. Air speed and/or water speed are again measured by environmental speed sensors 71 and 72 along the second leg L2 between the second location P2 and a third location P3. Wind velocity and/or a current velocity are then determined for each air and/or water speed measurement by subtracting the corresponding speed over ground measurement.

A wind vector and/or a current vector are then calculated based on the corresponding first and second velocity values. The wind vector describes a magnitude and a direction of the wind and the current vector describes a magnitude and a direction of the current. The first and second velocity values are measured at known headings separated by a known angle, illustrated as $\theta_4$ in FIG. 3. The heading direction of the first leg L1 and the heading direction of the second leg L2 must be sufficiently different such that differences in the wind and current can be reliably measured and sufficiently unaffected by measurement error. Thus, a threshold change in heading direction is required between the heading when the first velocity value is measured and the heading when the second velocity value is measured. To provide just one example, the threshold change in heading direction required between the first and second heading directions of the first and second legs L1 and L2 may be 10 degrees. However, the system 11 may be configured to implement smaller or lager thresholds, such as based on the resolution of the environmental speed sensor 71, 72, their placement, the number of speed sensors 71, 72 being used, etc. The control system 11 may be configured to wait for the threshold heading change to occur or to request that the user temporarily change the heading by the threshold amount. Alternatively, where an autonomous navigation controller is implemented, the navigation controller may temporarily implement the heading change to perform the measurement.

In some embodiments, an aggregate wind velocity and/or an aggregate current velocity may be determined for each of the legs L1 and L2 and the wind and/or current vectors may be calculated based on the aggregate velocity values. For example, a first aggregate wind velocity and/or first aggregate current velocity may be determined the first leg L1, or a portion thereof, based on multiple wind velocity and/or current velocity calculations at locations along the leg L1 or portion of the leg L1. Similarly, a second aggregate wind velocity and/or second aggregate current velocity may be determined for the second leg L2, or a portion thereof, based on multiple wind velocity and/or current velocity calculations at locations along the leg L2 or portion of the leg L2. For example, the control system 11 may be configured to periodically measure one or both of wind and/or water speed, and thus to determine the wind velocity and/or current velocity at the same frequency. The multiple wind velocity and/or current velocity values determined along a leg where the vessel is traveling straight in a consistent heading direction (e.g. leg L1 or leg L2) may be averaged or filtered or otherwise utilized together to determine an aggregate wind velocity and/or aggregate current velocity for the leg L1, L2 or for a portion of the leg.

The area for which the wind vector and/or a current vector are calculated to represent is based on the locations at which the wind speed and/or water speed are measured. Where the velocity values are based on a single speed measurement at a single measurement location in each heading direction, the area for which the wind and current vectors are calculated is defined by the two measurement locations. Where aggregate values are used, and thus the velocity values are based on multiple speed measurements taken at multiple locations, the area the area for which the wind and current vectors are calculated is defined by all of the measurement locations.

Figure 4:
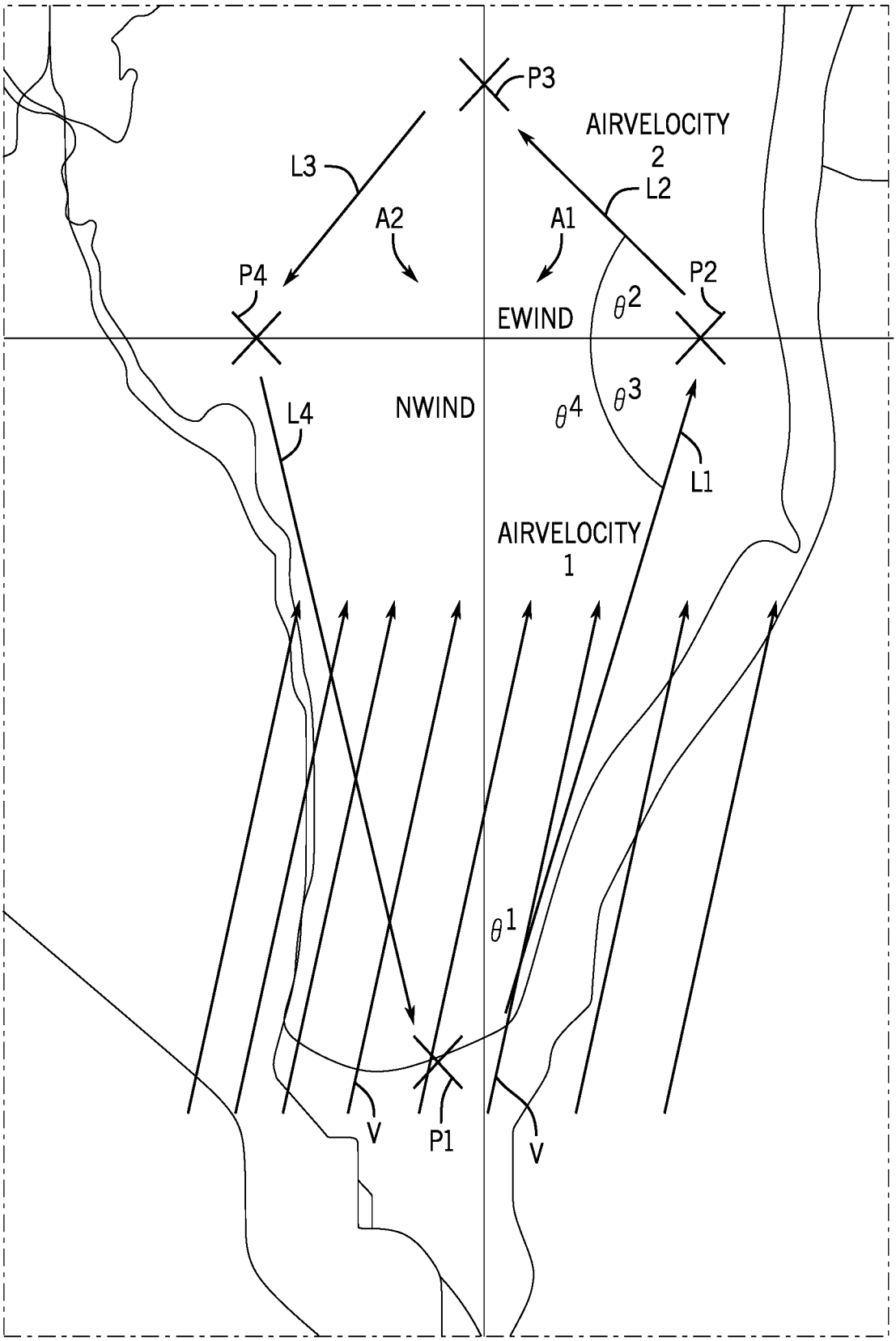

In some implementations, the disclosed method and system for wind vector and/or current vector calculations may be repeated in a plurality of measurement areas to generate a plurality of corresponding wind vectors and/or current vectors. A map of wind and/or current vectors may then be generated containing the plurality of vectors for the corresponding plurality of areas, thus mapping the wind vectors and/or current vectors for a larger area where the vessel has traveled and through which the vessel may be making a return trip. For example, FIG. 4 illustrates a map showing two measurement areas A1 and A2 defined based on the measurement locations, which could be one or more locations along each of the legs L1-L4 (which in this example complete a path back to the start location P1 but in other embodiments may be an open path with a different start and stop location). Wind vectors V are calculated for the first area A1 based on one or more measurements in the first measurement leg L1 and the second measurement leg L2. Wind vectors V are calculated for the second area A2 based on one or more measurements in the third measurement leg L3 and the fourth measurement leg L4.

Alternatively or additionally, the control system may be configured to communicate the map of vectors, such as via long range wireless communication networks such as cellular or satellite networks, or by radio communication, to a central receiver. Thereby, map vectors created by multiple different vessels can be aggregated together to cover a larger area and such maps may be communicated to or accessible by one or more devices operating with the control system 11, such as via a user's mobile device or an onboard management system.

In one embodiment, the wind vector and/or a current vector are calculated based on air speed, water speed, and speed over ground measurements according to the following equations. The calculation of a wind vector based on wind speed measurements is exemplified; however, the same equations apply equally to the calculation of a current vector based on current speed measurements.

A first wind velocity vector (AirVelocity1) is calculated based on a first measured air speed and a first speed over ground when the vessel is heading in a first heading direction. And then, once the vessel turns off of its initial heading by a threshold change in heading direction, the speed over ground and air speed are recorded again and a second wind velocity vector (AirVelocity2) is calculated. AirVelocity1 and AirVelocity2 are calculated as follows:

AirVelocity1=SensedAirVelocity2−SpeedOverGround1

AirVelocity2=SensedAirVelocity2−SpeedOverGround1

The two velocity vectors are then normalized into a North/South, East/West coordinate system. Using trigonometry from the wind speed vectors we can solve for each of a North wind value ("NWind," which may be positive or negative to indicate the wind velocity in the North/South direction) and an East wind value ("EWind," which may be positive or negative to indicate the wind velocity in the East/West direction) as follows:

$$\sin\Theta 1 = \frac{EWind}{AirVelocity1} \quad \cos\Theta 2 = \frac{EWind}{AirVelocity2}$$

$$\Theta 4(calc \text{ from } GPS) = \Theta 2 + \Theta 3 \quad \Theta 3 = \pi - \frac{\pi}{2} - \Theta 1$$

$$\Theta 1 = \frac{\pi}{2} - \Theta 4 + \Theta 2$$

$$\text{AirVelocity1} * \sin\left(\frac{\pi}{2} - \Theta 4 + \Theta 2\right) = EWind$$

$$\text{AirVelocity2} * \cos(\Theta 2) = EWind$$

$$\text{AirVelocity2} * \cos(\Theta 2) = \text{AirVelocity1} * \sin\left(\frac{\pi}{2} - \Theta 4 + \Theta 2\right)$$

$$\text{AirVelocity2} * \cos(\Theta 2) = \text{AirVelocity1} * \sin\left(\frac{\pi}{2} - \Theta 4 + \Theta 2\right)$$

$$\text{AirVelocity2} * \sin\left(\frac{\pi}{2} + \Theta 2\right) = \text{AirVelocity1} * \sin\left(\frac{\pi}{2} - \Theta 4 + \Theta 2\right)$$

$$\frac{\text{AirVelocity2}}{\text{AirVelocity1}} = \frac{\sin\left(\frac{\pi}{2} - \Theta 4 + \Theta 2\right)}{\sin\left(\frac{\pi}{2} + \Theta 2\right)}$$

$$\sin^{-1}\left(\frac{\text{AirVelocity2}}{\text{AirVelocity1}}\right) = \frac{\frac{\pi}{2} - \Theta 4 + \Theta 2}{\frac{\pi}{2} + \Theta 2}$$

$$\frac{\pi}{2} + \Theta 2 = \frac{\frac{\pi}{2} - \Theta 4 + \Theta 2}{\sin^{-1}\left(\frac{\text{AirVelocity2}}{\text{AirVelocity1}}\right)}$$

$$\frac{\pi}{2} + \Theta 2 = \frac{\frac{\pi}{2} - \Theta 4 + \Theta 2}{\sin^{-1}\left(\frac{\text{AirVelocity2}}{\text{AirVelocity1}}\right)}$$

$$\Theta 2 - \frac{\Theta 2}{\sin^{-1}\left(\frac{\text{AirVelocity2}}{\text{AirVelocity1}}\right)} = \frac{\frac{\pi}{2} - \Theta 4}{\sin^{-1}\left(\frac{\text{AirVelocity2}}{\text{AirVelocity1}}\right)} - \frac{\pi}{2}$$

$$EWind = \frac{\cos\Theta 2}{AirVelocity2}$$

$$NWind = \frac{\sin\Theta 2}{AirVelocity2}$$

Figure 5:
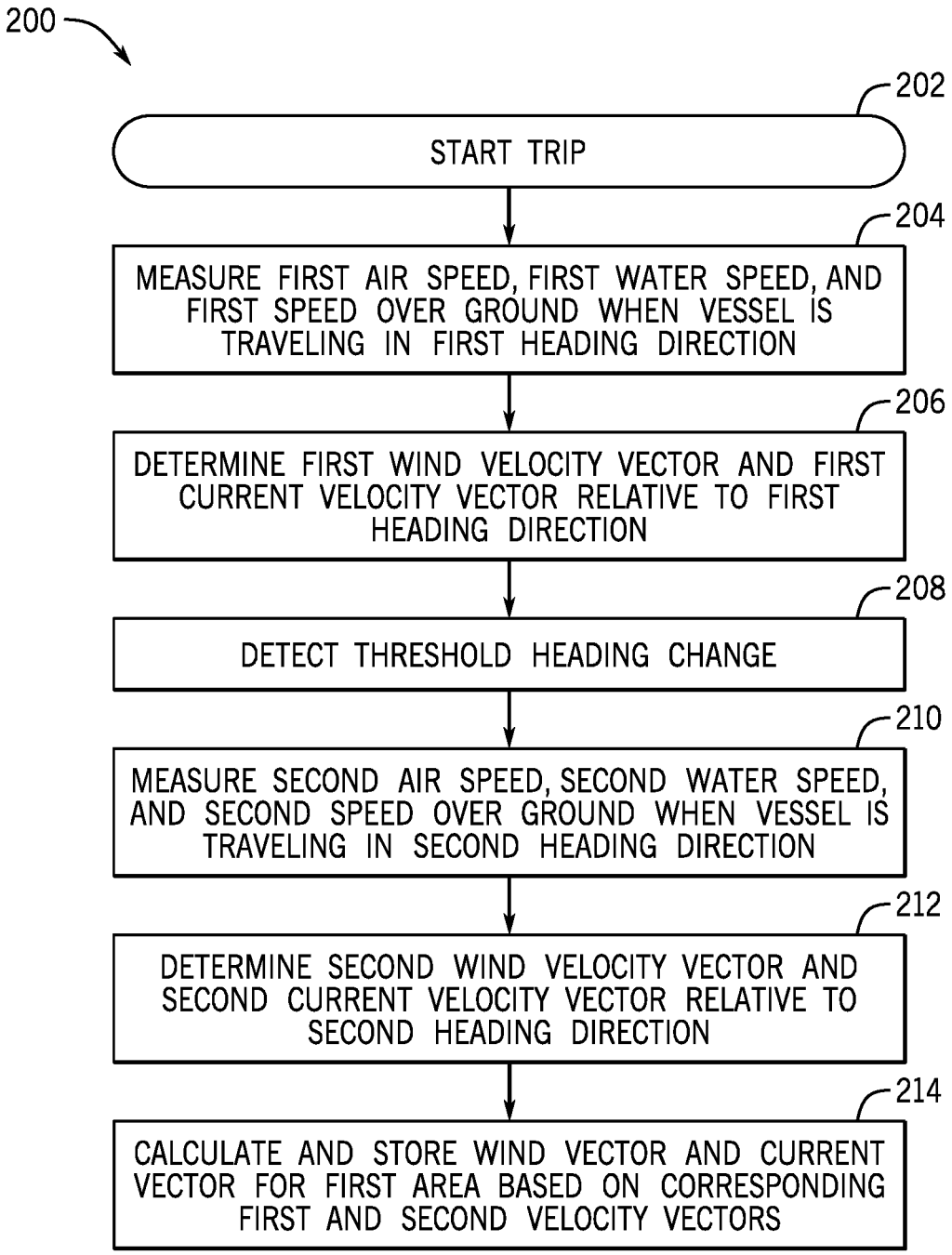
FIGS. 5 and 6 are flow charts illustrating embodiments of a method of monitoring an environment around a marine vessel according to the present disclosure.

FIG. 5 depicts one embodiment of method 200 of monitoring an environment around a marine vessel by calculating wind and current vectors. As described above, in some embodiments, just one of wind or current may be monitored and corresponding vector calculation performed. However, in FIG. 5 both wind and water speed are measured and thus both wind and current vectors are calculated. The trip starts at step 202. The system may be configured to trigger a trip start based on various indicators, such as first key up of at least one marine drive after a predetermined period of inactivity or upon user input to start a trip. A first air speed, a first water speed, and a first speed over ground are measured at step 204. For example, the first measurements may be performed at or near the location of startup, such as within a threshold distance of a start location of the trip. A first wind velocity vector and a first current velocity vector are then determined for the first heading direction at step 206 based on the speed measurements, such as by the calculation methods illustrated above. In some embodiments, wind and current vectors may be periodically determined as the vessel continues traveling in the first heading direction and aggregate first wind and current vectors may be determined for the first leg where the vessel was continually heading in the first direction.

The vessel heading is monitored to detect when a threshold change in vessel heading occurs. Once the threshold heading change is detected at step 208, second air speed, water speed, and speed over ground measurements are taken at step 210 as the vessel travels in the second heading direction. The system may be configured to determine that the vessel is traveling at a fixed heading (rather than in a turn) prior to taking the second measurements to avoid measurement error caused by the effects of the vessel turn dynamics. For example, the control system may be configured to determine that the second heading direction is maintained for a threshold time or a threshold distance before measuring the second air speed and/or the second water speed. A second wind velocity vector and/or a second current velocity vector are then determined for the second heading direction at step 212 based on the speed measurements, such as by the calculation methods illustrated above. In some embodiments, wind and current vectors may be periodically determined as the vessel continues traveling in the second heading direction and aggregate second wind and current vectors may be determined for the second leg where the vessel was continually heading in the second direction.

The wind vector and/or the current vector are then calculated for the area defined by the first and second measurement locations or the first and second legs for which aggregate measurements were determined. The wind vector and/or the current vector are determined based on the corresponding first and second velocity vectors and the first and second heading directions, such as by the calculation methods illustrated above. A wind and/or current map may then be generated containing the wind and/or current vector for the area. In some embodiments, a plurality of wind and/or current vectors are calculated for each of a plurality of areas and a map of the plurality of wind and/or current vectors is generated covering the plurality of areas. In some embodiments, interpolation can be utilized to bridge gaps between measurement areas to generate a cohesive map covering a larger area.

Figure 6:
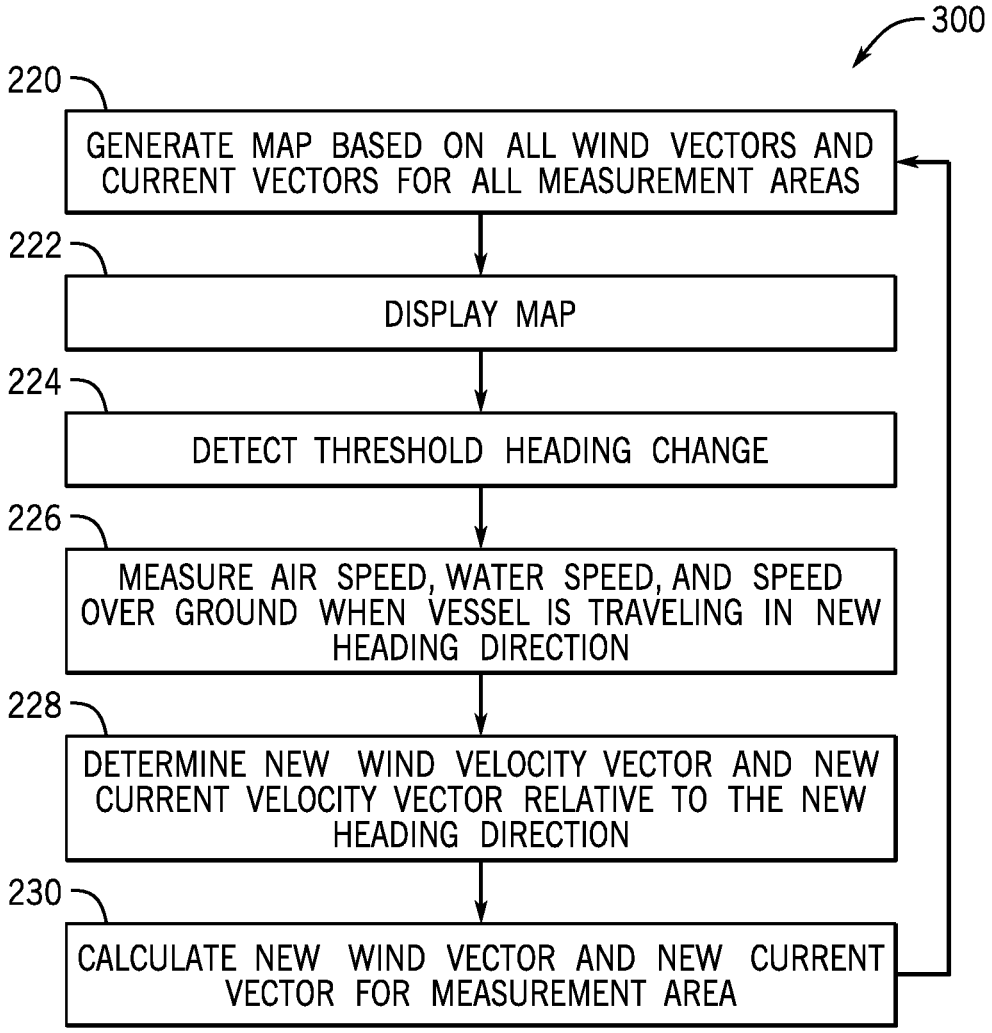

FIG. 6 depicts another embodiment of a method 300 of monitoring an environment around a marine vessel by calculating wind and current vectors that includes generating and displaying a map providing a visual representation of the environmental vectors thus showing the wind and/or current vectors calculated for the area(s) where the vessel has traveled. Building on the steps shown in FIG. 5, at step 220 the control system is configured to generate a map based on all wind vectors and all current vectors for the area(s) where the environmental vectors have been calculated by the system. The map is displayed at step 222, such as on a display device 40 at the helm, on a user's mobile device via an application communicating with the control system, or on some other display device visible to the operator or other user of the vessel. Once a threshold heading change is detected at step 224, air speed, water speed, and speed over ground are measured at step 226 while the vessel is heading in a new heading direction, as is described herein. A wind velocity vector and/or a current velocity vector are then determined at step 228 for the new heading direction. At step 230, a wind vector and/or a current vector are calculated for the new measurement area. The map is then updated and stored at step 230 such that the environmental vectors, wind and or water, around the vessel can be monitored as the vessel moves through various marine areas. Such information can then be utilized by the control system for monitoring and controlling aspects of the propulsion system, as well as displayed and or communicated to provide users with information about the environment.

Once calculated, the wind vector and/or the current vector may be utilized to determine various propulsion system parameter, a propulsion output requirement, and/or propulsion control instructions. For example, the wind and/or current vectors can be used to calculate direction-based battery range or fuel range for a vessel—e.g., a time-to-empty (TTE) and/or distance-to-empty-based on a given travel path. The required battery power is calculated based on the environmental vector(s), such as to account for the wind drag and/or the water drag on the vessel following a given path, such as from the vessel's present location to a predetermined trip end location. Thereby, an accurate battery range or fuel range is determined that accounts for environmental factors such as wind and current.

In some embodiments, the TTE and/or DTE may be calculated for multiple directions from a vessel's current location, or for multiple different travel paths. Thereby, the system may be configured to inform a user regarding use of the onboard energy stores so that they can select a travel path accordingly. For example, the system may be configured to generate a notice advising a user of the battery range in one or multiple directions.

Alternatively or additionally, the environmental vector(s) and mapped environmental vectors may be utilized for other vessel control purposes, such as for purposes of navigation, thrust compensation calculations for negating the environmental force(s), path planning, or the like. For example, the control system may be configured to calculate or modify a required thrust to propel the marine vessel in a direction based on the wind vector and/or the current vector. For instance, the control system may be configured to calculate a propulsion control value (e.g., RPM, current, torque, etc.) for the marine drive based on the applicable the wind vector and/or current vector, such as to achieve a certain vessel velocity accounting for the wind and/or current forces. Alternatively or additionally, the control system may be configured to plan a navigation path to account for the environmental vector(s), such as to allow a wider berth around objects and obstacles downstream of the environmental vector so that the vessel is less likely to be pushed into the obstacle by the environmental forces.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A system for monitoring an environment around a marine vessel, the system comprising:
- at least one environmental speed sensor configured to measure at least one of an air speed or a water speed around the marine vessel;
- a vessel sensing system configured to measure a speed over ground of the marine vessel and a heading direction of the marine vessel;
- a control system configured to:
  - receive a plurality of air speed measurements and/or a plurality of water speed measurements measured by the at least one environmental speed sensor when the marine vessel is heading in a plurality of different heading directions;
  - determine a plurality of wind velocities and/or a plurality of current velocities based on the plurality of air speed measurements and/or the plurality of water speed measurements and the speed over ground and the heading direction at the time of obtaining each respective air speed measurement and/or water speed measurement; and
  - calculate a wind vector and/or a current vector for an area traveled by the marine vessel based on the plurality of wind velocities and/or the plurality of current velocities.

2. The system of claim 1, wherein the control system is further configured to determine a propulsion system parameter, a propulsion output requirement, and/or control propulsion based on the wind vector and/or a current vector.

3. The system of claim 1, wherein the control system is further configured to generate a visual representation of the wind vector and/or a representation of the current vector and to display the visual representation on the display.

4. The system of claim 1, wherein the control system is further configured to:
- receive a first air speed and/or a first water speed measured by the environmental speed sensor and a first speed over ground of the marine vessel when the marine vessel is at a first location traveling in a first heading direction;
- determine a first wind velocity relative to the first heading direction based on the first air speed and the first speed over ground and/or determine a first current velocity relative to the first heading direction based on the first water speed and the first speed over ground;
- detect a threshold change in heading direction of the marine vessel to a second heading direction;
- measure a second air speed and/or a second water speed with the environmental speed sensor on the marine vessel and measure a second speed over ground of the marine vessel when the marine vessel is at a second location traveling in the second heading direction;
- determine a second wind velocity based on the second air speed and the second speed over ground and/or determine a second current velocity based on the second water speed and the second speed over ground; and
- calculate the wind vector for the area based on the first wind velocity and the second wind velocity and/or calculate the current vector for the area based on the first current velocity and the second current velocity, wherein the area includes at least the first location and the second location.

5. The system of claim 4, further comprising at least two air speed sensors at different locations on the marine vessel, each generating air speed measurements, and wherein the control system is further configured determine the first air speed and the second air speed based on multiple air speed measurements from each of the at least two air speed sensors.

6. The system of claim 4, wherein the control system is further configured to identify that the second heading direction is maintained for a threshold time or a threshold distance before receiving the second air speed and/or the second water speed.

7. The system of claim 1, further comprising at least one air speed sensor and at least one water speed sensor, and wherein the control system is configured to calculate the wind vector based on the plurality of air speed measurements from the air speed sensor and to calculate the current vector based on the plurality of water speed measurements from the water speed sensor.

8. The system of claim 1, wherein the control system is further configured to calculate a second wind vector and/or a second current vector for a second area traveled by the marine vessel based on a second plurality of wind velocities and/or a second plurality of current velocities.

9. The system of claim 8, wherein the control system is further configured to generate a map of wind vectors and/or current vectors in each of the area and at least the second area.

10. The system of claim 9, wherein the control system is further configured to generate a visual representation of the map of wind vectors and/or current vectors and to display the visual representation on the display.

11. A method of monitoring an environment around a marine vessel, the method comprising:

measuring a first air speed and/or a first water speed with at least one environmental speed sensor on the marine vessel;

measuring a first speed over ground of the marine vessel with a vessel speed sensor when the marine vessel is at a first location traveling in a first heading direction;

determining by a processor a first wind velocity relative to the first heading direction based on the first air speed and the first speed over ground and/or determining a first current velocity relative to the first heading direction based on the first water speed and the first speed over ground;

detecting by the processor a threshold change in heading direction of the marine vessel to a second heading direction;

measuring a second air speed and/or a second water speed with the environmental speed sensor on the marine vessel and measuring a second speed over ground of the marine vessel with the vessel speed sensor when the marine vessel is at a second location traveling in the second heading direction;

determining by the processor a second wind velocity based on the second air speed and the second speed over ground and/or determining a second current velocity based on the second water speed and the second speed over ground; and calculating by the processor a wind vector for a first area based on the first wind velocity and the second wind velocity and/or calculating a current vector for the first area based on the first current velocity and the second current velocity, wherein the first area includes at least the first location and the second location.

12. The method of claim 11, further comprising maintaining the second heading direction for a threshold time or a threshold distance before measuring the second air speed and/or the second water speed.

13. The method of claim 11, further comprising periodically measuring speed over ground and air speed and/or water speed while the marine vessel is traveling in the first heading direction and determining the first wind velocity relative to the first heading direction based on a plurality of air speed and speed over ground measurements made while the marine vessel is traveling in the first heading direction and/or determining by the processor the first current velocity relative to the first heading direction based on a plurality of water speed and speed over ground measurements made while the marine vessel is traveling in the first heading direction.

14. The method of claim 11, wherein the first location is within a threshold distance of a start location of a trip.

15. The method of claim 11, wherein the first area includes at least a third location where a third wind velocity and/or a third current velocity are determined.

16. The method of claim 11, further comprising measuring air speed and water speed at a plurality of other locations in addition to the first location and the second location and generating a map of wind vectors and/or current vectors in each of the first area and a plurality of other areas defined based on the plurality of other locations.

17. The method of claim 11, further comprising calculating by the processor the wind vector for the first area based on the first wind velocity and the second wind velocity and calculating the current vector for the first area based on the first current velocity and the second current velocity.

18. The method of claim 11, further comprising communicating by the processor the wind vector and/or the current vector to a navigation controller for determining a propulsion output requirement by at least one marine drive.

19. The method of claim 11, further comprising communicating by the processor the wind vector and/or the current vector to a controller for determining an energy output requirement for at least one marine drive on the marine vessel.

20. The method of claim 11, further comprising displaying a representation of the wind vector and/or a representation of the current vector on a display.

21. The method of claim 11, further comprising determining by the processor the first air speed and the second air speed based on multiple air speed measurements from each of at least two air speed sensors at different locations on the marine vessel.

* * * * *